United States Patent [19]

Cloer

[11] Patent Number: 4,472,618

[45] Date of Patent: Sep. 18, 1984

[54] LUMBER CART AND ELECTRODE FOR DIELECTRIC DRYING KILN

[75] Inventor: Nathaniel W. Cloer, Pickens, S.C.

[73] Assignee: Power Dry Patent, Inc., Easley, S.C.

[21] Appl. No.: 359,113

[22] Filed: Mar. 17, 1982

[51] Int. Cl.[3] ..... H05B 6/54; H05B 6/60

[52] U.S. Cl. ..... 219/10.81; 219/10.67; 219/10.69; 414/347; 414/188; 34/1; 34/236

[58] Field of Search ..... 219/10.81, 10.67, 10.69, 219/10.71, 10.57, 10.61 R, 388, 459; 414/155, 187, 188, 341, 347, 348; 34/1, 236, 203, 204

[56] References Cited

U.S. PATENT DOCUMENTS

| | | | |
|---|---|---|---|
| 2,543,618 | 2/1951 | Wood | 219/10.81 X |
| 2,808,157 | 10/1957 | Terrill | 414/347 |
| 3,986,268 | 10/1976 | Koppelman | 34/1 |
| 4,007,350 | 2/1977 | Gillet | 219/10.81 |

*Primary Examiner*—B. A. Reynolds

*Assistant Examiner*—Philip H. Leung

*Attorney, Agent, or Firm*—Sutherland, Asbill & Brennan

[57] ABSTRACT

A lumber cart for use in a dielectric drying kiln, in which the cart is comprised of a wheeled, horizontal frame, a flat bed of electrically conductive material, preferably aluminum, carried on top of the frame, and one or more electrical leads or terminals connected to the bed, is improved to facilitate loading and unloading of the lumber, by the bed being formed of at least one set of three rectangular sections in side-by-side relationship, the two outside sections of the set being capable of being elevated to a level above the center section, and the cart being provided with means underneath the bed for temporarily elevating the two outside sections and for holding those sections in the elevated position while supporting a stack of lumber by its ends when the stack is laid lengthwise across and above the center section. A similarly constructed separate electrode is also disclosed.

30 Claims, 14 Drawing Figures

LUMBER CART AND ELECTRODE FOR DIELECTRIC DRYING KILN

This invention relates to equipment used in the dielectric drying of lumber. More particularly, it relates to a lumber cart for dielectric drying kilns wherein the deck of the cart constitutes one of the electrodes used to transmit the high frequency current through the lumber being dried, and, particularly, to an improvement for such a cart that facilitates its loading and unloading. It also relates to a separate electrode that can be used in the center of the lumber that is stacked on such a cart.

In U.S. Pat. No. 3,986,268 a lumber cart for use in a dielectric drying kiln is disclosed. (See FIG. 3 of the patent). The cart is comprised of a wheeled, horizontal frame, on top of which is carried a flat bed of electrically conductive material. The bed has electrical leads connected to it and it serves as the negative electrode for the passage of high frequency alternating current through the lumber to be dried.

A problem with the cart shown in U.S. Pat. No. 3,986,268 is that it is difficult to load and unload. The bottom layer of lumber must be in direct and complete contact with the bed of the cart during the drying process. Therefore, the lumber cannot be supported on a pallet of the type that has a few inches of open space beneath it to permit the tines of a forklift to be inserted to facilitate loading and unloading. Consequently, a forklift simply cannot be used effectively to load or unload the cart disclosed in the patent. The most obvious alternative to the use of a forklift is stacking and unstacking the lumber by hand, which is an expensive and time-consuming operation.

I have invented an improved lumber cart for use in dielectric drying kilns, which can be loaded by use of a forklift. In the cart of my invention the bed is formed of at least one set of three rectangular sections in side-by side relationship, the two outside sections thereof being capable of being elevated to a level above the center section, and the cart being provided with means underneath the bed for temporarily elevating the two outside sections and for holding those sections in the elevated position while supporting a stack of lumber by its ends, when the stack is laid lengthwise across and above the center section. The center section is wide enough that the tines of a forklift can move in and out above it, without touching the adjacent outside sections. The means for elevating the outside sections is effective to raise those sections a sufficient vertical distance above the plane of the surface of the center section that the tines of a forklift can be lowered from a stack of lumber held by the outside sections, and the forklift then backed away from the cart, without the tines hitting or dragging across the center section. After the loading or unloading is complete and the forklift has been backed away from the cart, the outside sections of the deck are then lowered to their bottom position, where they once again are on a plane with the center section.

My improved cart makes it possible to load and unload lumber by use of a forklift, without damage to the electrode bed of the cart. The expense and delay of stacking the lumber on the cart by hand, and unloading it in the same manner, are thus avoided.

The cart of my invention can be provided with any number of sets of the side-by-side rectangular deck sections just described. All adjacent edges of the sections will preferably be in electrical contact with one another when the outside sections are in their fully lowered positions. This may be accomplished, for example, by having an elongated member made of conducting material underlay the gap between each pair of adjacent edges so that the material contacts both sections when the outside section is in the fully lowered position. In a preferred embodiment this elongated member will be part of the frame of the cart. Aluminum is the preferred material for the elongated member, as well as for the bed of the cart.

The distance between the outside edges of the tines of a forklift is ordinarily in the range of about 16 to 30 inches. Preferably, therefore, each center section in the bed of the cart of the present invention will be at least about 18 inches wide, e.g., in the range of about 18 to 36 inches wide, so as to accommodate conventional forklifts.

The means for elevating each outside section in the bed preferably includes one or more inflatable bags, e.g., air bags made of heavy duty rubber. The preferred height of elevation is at least about 2 inches above the plane of the surface of the center section, e.g., in the range of about 2 to 5 inches above that plane. That will ordinarily be enough room for safe insertion and withdrawal of the forklift's tines underneath the stack of lumber.

In one arrangement of equipment for dielectric drying of lumber of horizontally disposed electrode plate can be positioned between upper and lower stacks of the lumber. Such an arrangement can be used, for example, when a total of three electrodes are employed—a positive electrode in the center and two negative electrodes on the top and bottom of the load of lumber. All else being equal, greater drying efficiency can be achieved by using this layered arrangement than by sandwiching the same amount of lumber in one stack between just two electrodes.

When using an interior, horizontally disposed electrode plate, however, the same loading problems exist as are experienced in using the lumber cart whose bed is an electrode. If the top surface of the interior electrode is flat and unadjustable, a forklift cannot be used to stack lumber on it.

The electrode of the present invention incorporates the essential features of the improved lumber cart just described in order to obviate that problem. The electrode is comprised of a generally flat, rectilinear box of conductive material, preferably aluminum, with one or more electrical leads connected to it. The top surface of the box (like the bed of the lumber cart) is formed of at least one set of three rectangular sections in side-by-side relationship, with the two outside sections being capable of being elevated to a level above the center section. Inside the box are means for temporarily elevating the two outside sections in each set, and for holding those sections in the elevated position while supporting a stack of lumber by its ends, when the stack is laid lengthwise across and above the center section. Just as in the case of the cart bed, each center section of the top surface of the box electrode is wide enough to permit the tines of a forklift to move in and out above it, without touching the adjacent outside sections. Also, the means for elevating the outside sections are effective to raise those sections a sufficient vertical distance above the plane of the surface of the center section that the tines of the forklift can be lowered from the stack of lumber held by the outside sections, and the forklift then backed away from the electrode without the tines hitting or dragging across the center section.

The drawings accompanying this specification illustrate preferred embodiments of the cart and electrode of the present invention. Referring to those drawings.

Figure 1:
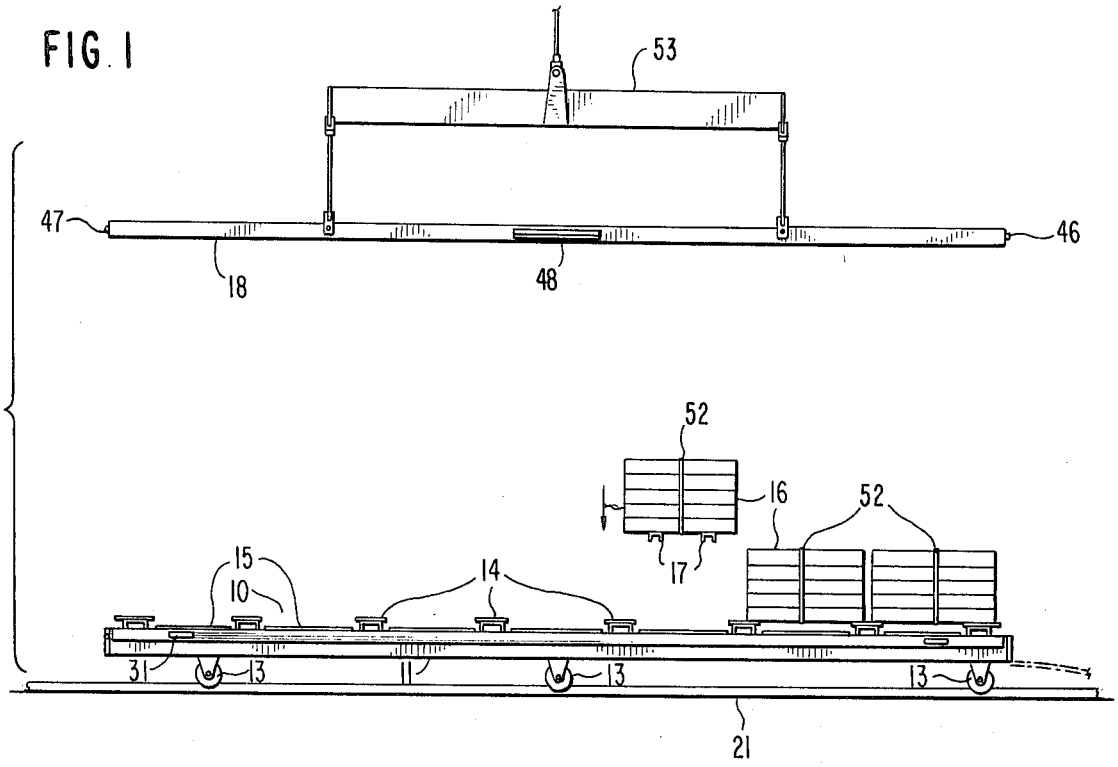
FIG. 1 is a side view of a lumber cart of the present invention in the process of being loaded with packages of green lumber, with a companion electrode of the present invention suspended above the cart from a hoist.

Referring to FIG. 1 of the drawings, the lumber cart, indicated generally as 10, is formed of a horizontal frame defined by steel tubular side members 11 and steel tubular end members 12, mounted on six V-groove steel wheels 13. Carried on top of the frame is a bed of one-quarter inch plate aluminum sections: narrow, elevatable sections 14, alternating with wide, immovable sections 15. In the apparatus shown in the drawings, each center section 15 may advantageously be about 22 inches wide.

Figure 2:
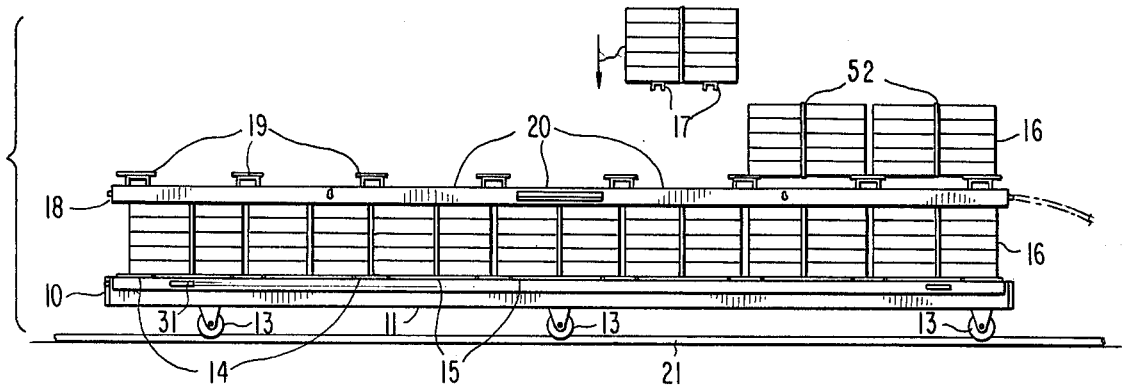
FIG. 2 is a side view of the cart and electrode of FIG. 1 at a later stage in the loading process, with the electrode resting on a bottom layer of lumber packages.

As illustrated in FIG. 1, to load cart 10 the elevable sections 14 are raised, preferably about 4 inches, and packages of green lumber 16 are lowered in place by a forklift over the immovable center sections 15. Each package is held together by a center band 52. Once each package 16 is in position, with the ends of the lumber supported on the outside sections 14, tines 17 of the forklift are lowered slightly from the package and the forklift is backed away from cart 10, without the tines 17 hitting or dragging across the surface of center section 15. Once cart 10 is fully loaded, deck sections 14 are lowered to the level of the immovable sections 15, which is the position they occupy in FIGS. 2 and 3. Center electrode 18 is then lowered by hoist 53 to rest on top of the lumber packages, as illustrated in FIG. 2.

Figure 3:
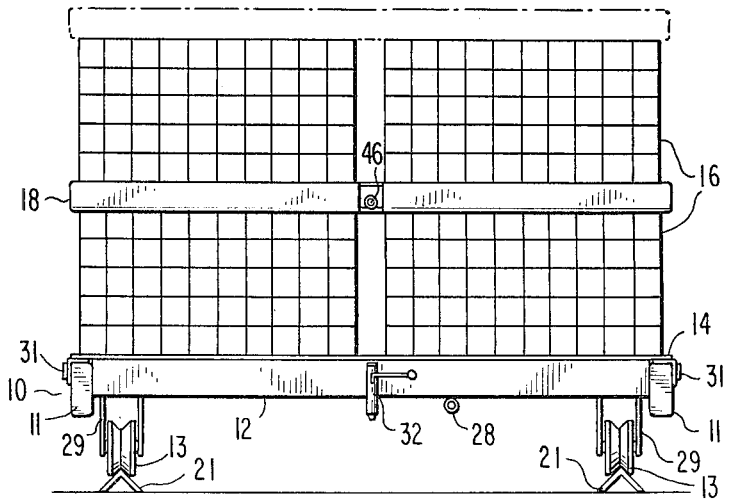
FIG. 3 is an enlarged end view of the cart and electrode of FIGS. 1 and 2 after the loading process has been completed.
Figure 4:
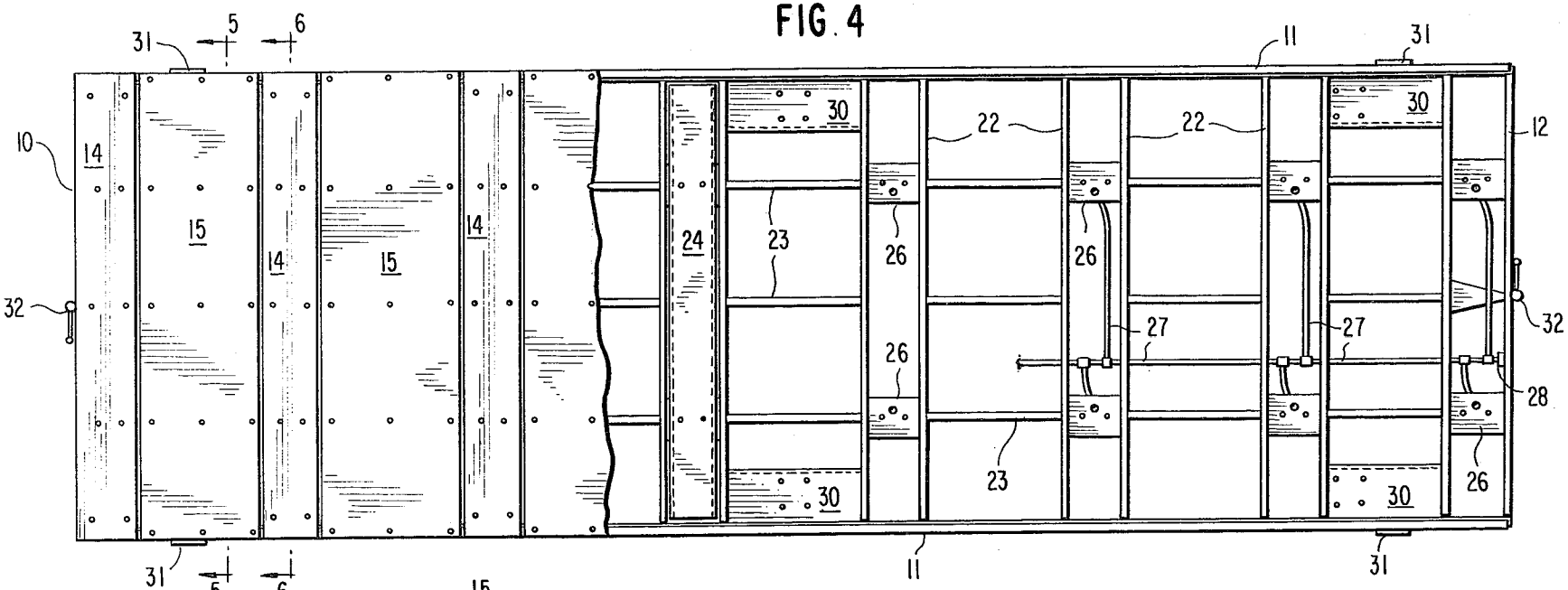
FIG. 4 is a top view, partially broken away, of the cart of FIGS. 1-3, on a slightly smaller scale than shown in FIG. 3.
Figure 5:
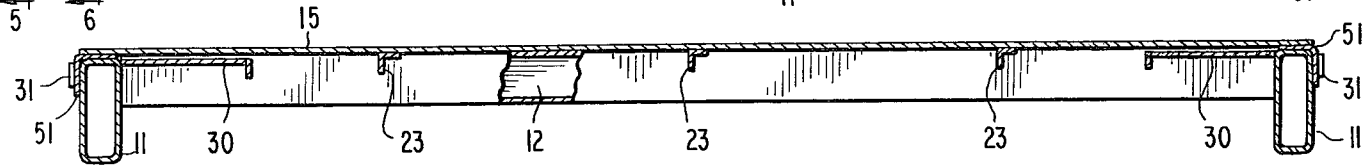
FIG. 5 is a sectional view of the cart, taken along line 5—5 in FIG. 4 and enlarged.

The top surface of center electrode 18 is similarly formed of narrow, elevatable sections 19, alternating with wide, immovable sections 20, both made of one-quarter inch aluminum plate. Loading of the top layer of lumber packages 16 on center electrode 18 is accomplished in the same manner as loading the bottom layer on cart 10. Elevatable sections 19 are raised and held in their raised positions, while packages 16, carried on forklift tines 17, are laid end-to-end on the series of upraised sections 19. When loading of the top layer of lumber packages is complete, outside sections 19 are lowered to the level of center sections 20. The cart is then ready to be rolled into the dielectric drying kiln (not shown) on rails 21. Once inside the kiln, a third electrode plate, shown in broken lines in FIG. 3, is placed on the top layer of lumber, the center electrode is connected to a source of radio frequency electric current, and the upper and lower electrodes are connected to ground. The lumber is now ready to be dried dielectrically.

Figure 6:
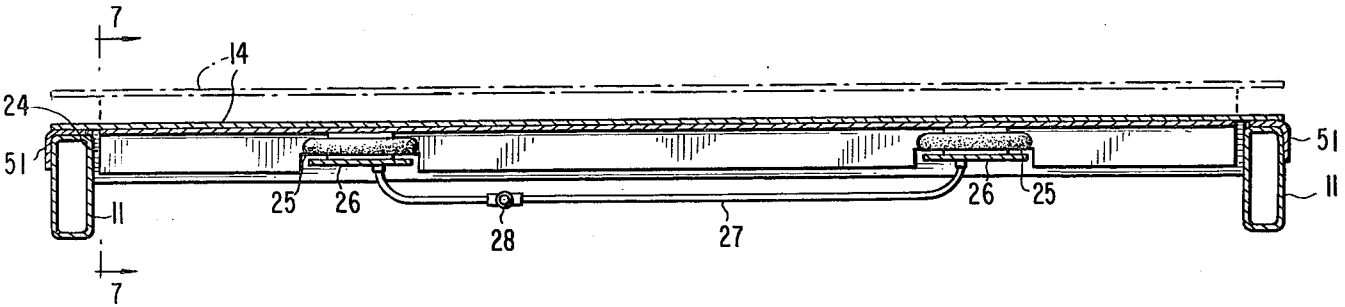
FIG. 6 is a different sectional end view of the cart, taken along line 6—6 in FIG. 4 and enlarged to the same scale as FIG. 5.
Figure 7:
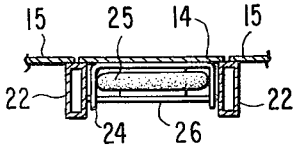
FIG. 7 is a sectional side view of a portion of the cart, taken along line 7—7 in FIG. 6.
Figure 8:
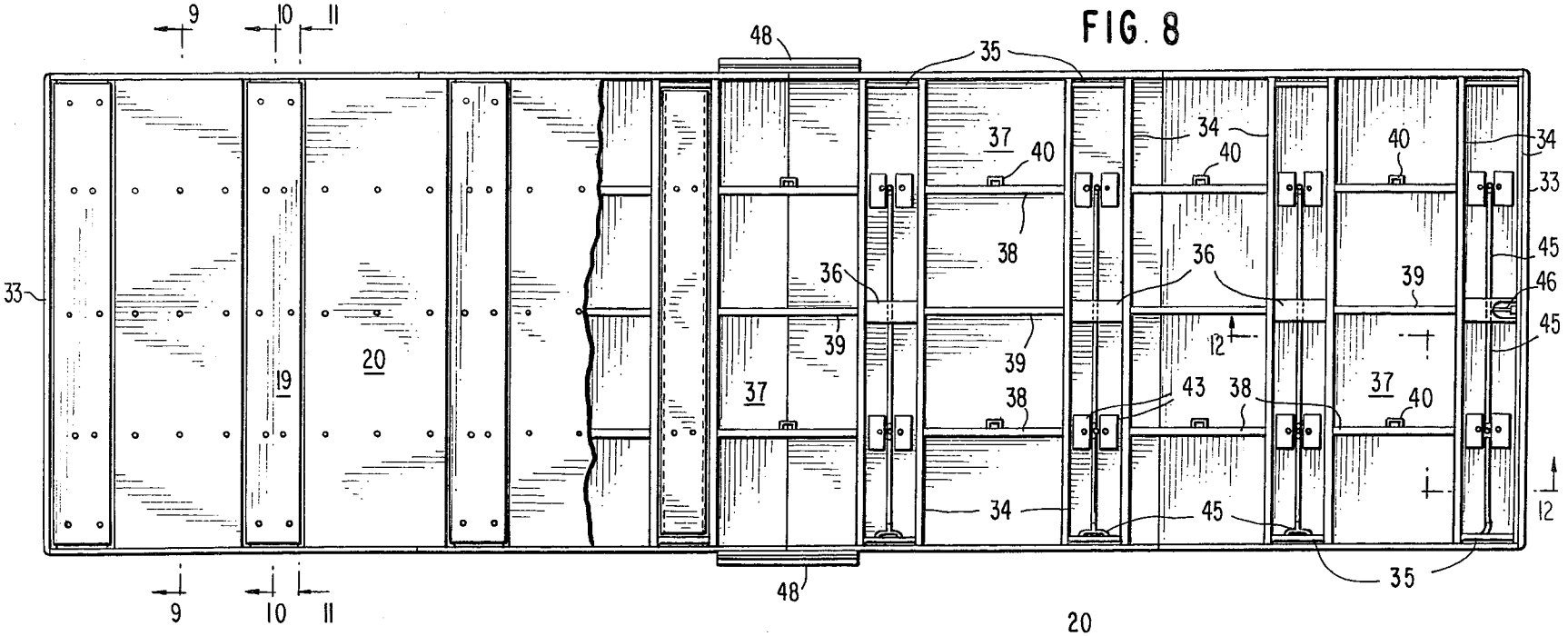
FIG. 8 is a top view, partially broken away, of the electrode of FIGS. 1-3, also on a slightly smaller scale than shown in FIG. 3.
Figure 9:
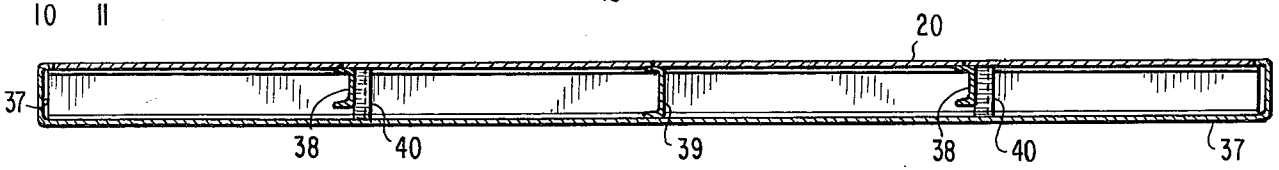
FIG. 9 is a sectional end view of the electrode, taken along line 9—9 in FIG. 8 and enlarged.
Figure 10:
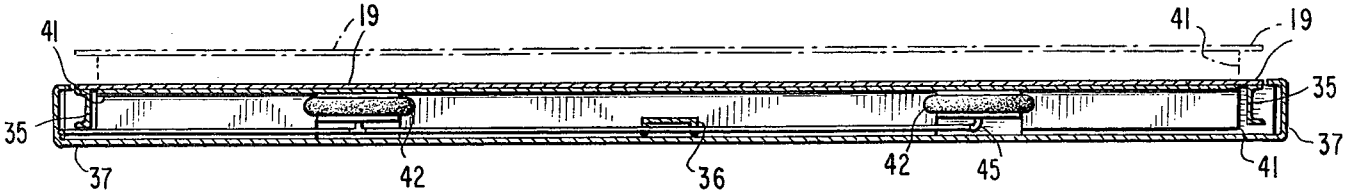
FIG. 10 is a different sectional end view of the electrode, taken along ling 10—10 in FIG. 8 and enlarged to the same scale as FIG. 9.
Figure 11:
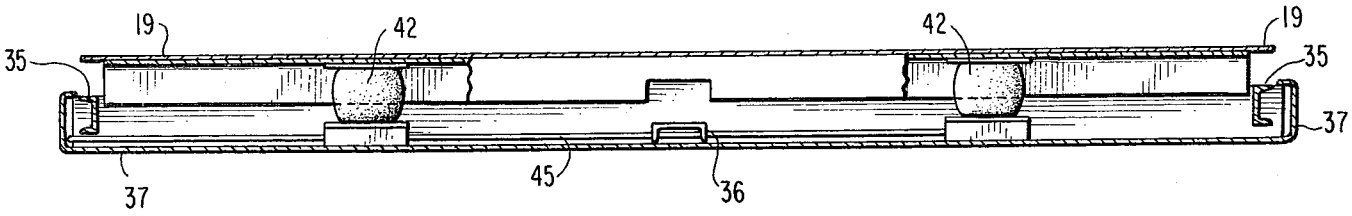
FIG. 11 is still another sectional end view of the electrode, taken along line 11—11 in FIG. 8 and also enlarged to the same scale as FIG. 9.
Figure 12:
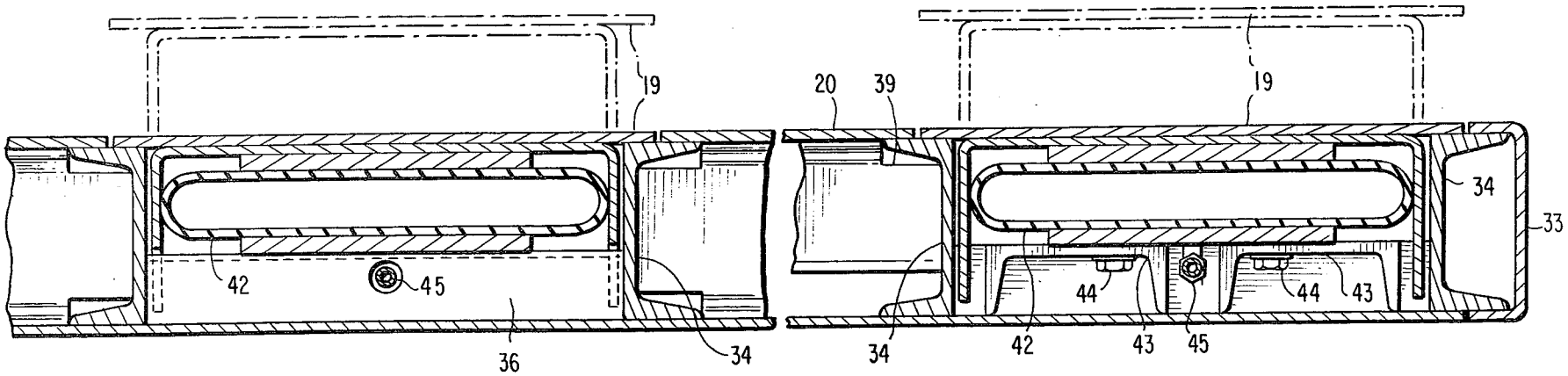
FIG. 12 is a sectional side view (partially broken away) of the right-hand end of the electrode, taken along line 12—12 in FIG. 8 and enlarged.
Figure 14:
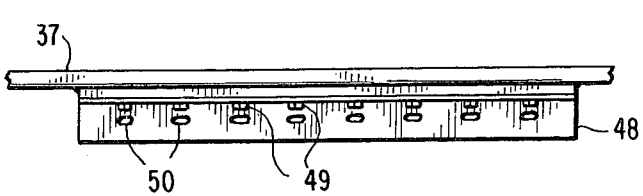
FIG. 14 is a top view of the connecting terminal shown in FIG. 13.
Figure 13:
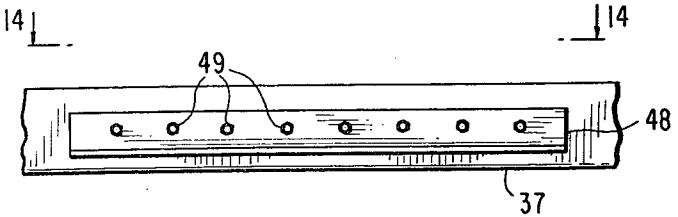
FIG. 13 is a side view of the connecting terminal of the electrode shown in FIGS. 8-12, but drawn to a slightly larger scale than used in FIG. 9.

As shown in FIGS. 4-7, the frame of cart 10 is made of tubular side members 11, tubular end members 12, tubular aluminum ribs 22, and stretcher members 23 made of aluminum angle iron. Immovable deck sections 15 are welded to side members 11 and to stretcher members 23, both of which are made of steel angle iron. As shown in FIGS. 6 and 7, each elevatable deck section 14 is attached to an air bag header 24, which is a length of steel channel that fits between ribs 22. The downturned lengthwise edges of header 24 serve to guide the header and keep section 14 from tilting or rocking as header 24 rides up and down between the ribs 22. (See broken lines in FIG. 6 for elevated position of section 14). The top surface of each aluminum rib 22 underlays the adjacent edges of sections 14 and 15 and provides good electrical contact between those sections when section 14 is in the fully lowered position. Mounted below each elevatable deck section 14 are two air bags 25 which are held by two air bag support plates 26 that are welded to adjacent ribs 22. A network of air lines 27 connects all of the bags 25 to air inlet neck 28, which is fitted for quick coupling to a compressed air supply line, shown in broken lines in FIG. 1.

Each wheel 13 of the cart 10 is carried by a rigid axle bracket 29 which is mounted to a base plate 30 that is welded to adjacent ribs 22.

Four aluminum grounding plates 31 are welded to elongated aluminum caps 51, which are in turn welded to steel side members 11 of the cart. The short edges of all of the deck sections 14 and 15 overlap the top surfaces of caps 51 when the elevatable sections 14 are in their fully lowered positions, thus providing good electrical contact between all of the deck sections and the grounding plates 31.

Tow pins 32 are carried on both of the frame's end members 12, to permit the cart to be attached at either end to conveyor means (not shown) for moving the cart back and forth over rails 21.

FIGS. 1-3 and 8-14 of the drawings reveal the construction of the center electrode 18, which is quite similar to that of cart 10. The frame for electrode 18 is formed of a gridwork of cross members 34, connected by rib members 35, 36 38, and 39, all made of aluminum channel. The bottom and long sides of the frame are wrapped with four side-by-side sheets of one-quarter inch thick aluminum 37. The short sides of the frame are covered with caps 33 of the same material.

Immovable sections 20 of the top surface of electrode 18 are also formed of one-quarter inch sheet aluminum, which is welded to cross members 34 and ribs 38 and 39. Added support against the weight of lumber to be stacked on top of the electrode is provided by vertical braces 40, which are also formed of aluminum channel and are welded to rib members 38.

Elevatable sections 19 of the top surface of electrode 18 are likewise formed of one-quarter inch sheet aluminum. They are bolted (stainless steel bolts not shown) to air bag headers 41, which are elongated channel members made of sheet steel. Headers 41 fit closely between adjacent cross members 34 and ride up and down on air bags 42, which are mounted by bolts 44 on support plates 43, which are formed of relatively short lengths of aluminum channel. Air pressure to inflate bags 42 is supplied through a network of air lines 45 that extends between necks 46 and 47, located at opposite ends of electrode 18. Both necks 46 and 47 are fitted for quick coupling with a source of compressed air, shown in broken lines in FIG. 2. Either neck can be used for the inflation.

Attached to each of the long sides of electrode 18 is a length of aluminum angle iron 48 which serves as a terminal for connecting the electrode to a hot lead (not shown). Angle iron 48 is bolted to the upturned edges of two of the aluminum panels 37 by a series of brass bolts 49. Slotted holes 50 in angle iron 48 permit one or more flat conductors (not shown) to be clamped to the iron as the hot lead.

I claim:

1. In a lumber cart for use in a dielectric drying kiln, the cart being comprised of a wheeled, horizontal frame, a flat bed of electrically conductive material carried on top of the frame, and one or more electrical leads or terminals connected to said bed, the improvement wherein (a) the bed is formed of at least one set of three rectangular sections in side-by-side relationship, the two outside sections thereof being capable of being elevated to a level above the center section, and (b) the cart is provided with means underneath the bed for temporarily elevating the two outside sections and for holding those sections in the elevated position while supporting a stack of lumber by its ends when the stack is laid lengthwise across and above the center section, the center section being wide enough that the tines of a forklift can move in and out above it without touching the adjacent outside sections, and the means for elevating the outside sections being effective to raise those sections a sufficient vertical distance above the plane of the surface of the center section that said tines can be lowered from said stack of lumber and the forklift can then be backed away from cart, without the tines hitting or dragging across the center section.

2. The lumber cart of claim 1 wherein each center section is at least about 18 inches wide.

3. The lumber cart of claim 2 wherein the means for elevating the outside sections includes one or more inflatable bags mounted under each section.

4. The lumber cart of claim 1 wherein the means for elevating the outside sections includes one or more inflatable bags mounted under each section.

5. The lumber cart of claim 1 wherein all adjacent edges of the sections forming the deck are in electrical contact with one another when the outside sections are in their fully lowered positions.

6. The lumber cart of claim 5 wherein the electrical contact between each pair of adjacent edges comprises an elongated frame member, made of conducting material, that is aligned with the edges, underlays both edges, and contacts both sections when the outside section is in the fully lowered position.

7. The lumber cart of claim 1 wherein the bed is made of aluminum.

8. The lumber cart of claim 2 wherein the bed is formed of a plurality of said sets of side-by-side, rectangular sections.

9. The lumber cart of claim 8 wherein the means for elevating the outside sections includes one or more inflatable bags mounted under each section.

10. The lumber cart of claim 8 wherein the width of each center section is within the range of about 18 to 36 inches.

11. The lumber cart of claim 10 wherein the means for elevating the outside sections is capable of elevating those sections a vertical distance in the range of about 2 to 5 inches above the plane of the surface of the center section.

12. The lumber cart of claim 11 wherein all adjacent edges of the sections forming the deck are in electrical contact with one another when the outside sections are in their fully lowered positions.

13. The lumber cart of claim 11 wherein the bed is made of aluminum.

14. The lumber cart of claim 11 wherein the means for elevating the outside sections includes one or more inflatable bags mounted under each section.

15. The lumber cart of claim 14 wherein the bed is made of aluminum.

16. The lumber cart of claim 14 wherein all adjacent edges of the sections forming the deck are in electrical contact with one another when the outside sections are in their fully lowered positions.

17. The lumber cart of claim 16 wherein the electrical contact between each pair of adjacent edges comprises an elongated frame member, made of conducting material, that is aligned with the edges, underlays both edges, and contacts both sections when the outside section is in the fully lowered position.

18. The lumber cart of claim 19 wherein the bed is made of aluminum.

19. A plate electrode for use in a horizontal disposition between upper and lower stacks of lumber to be dried in a dielectric drying kiln, the electrode being comprised of (a) a generally flat, rectilinear box of conductive material, the top surface of the box being formed of at least one set of three rectangular sections in side-by-side relationship, the two outside sections thereof being capable of being elevated to a level above the center section, (b) one or more electrical leads or terminals connected to the box, and (c) means inside the box for temporarily elevating the two outside sections and for holding those sections in the elevated position while supporting a stack of lumber by its ends, when the stack is laid lengthwise across and above the center section, the center section being wide enough that the tines of a forklift can move in and out above it without touching the adjacent outside sections, and the means for elevating the outside sections being effective to raise those sections a sufficient vertical distance above the plane of the surface of the center section that said tines can be lowered from said stack of lumber and the forklift then backed away from cart, without the tines hitting or dragging across the center section.

20. The electrode of claim 19 wherein each center section is at least about 18 inches wide.

21. The electrode of claim 20 wherein the box is made of aluminum.

22. The electrode of claim 20 wherein all adjacent edges of the sections forming the top surface are in electrical contact with one another when the outside sections are in their fully lowered positions.

23. The electrode of claim 22 wherein the electrical contact between each pair of adjacent edges comprise an elongated member, made of conducting material, that is aligned with the edges, underlays both edges, and contacts both of the sections when the outside section is in the fully lowered position.

24. The electrode of claim 20 wherein the top surface is formed of a plurality of said sets of side-by-side rectangular sections.

25. The electrode of claim 24 wherein the width of each center section is within the range of about 18 to 36 inches.

26. The electrode of claim 25 wherein the means for elevating the outside sections is capable of elevating those sections a vertical distance in the range of about 2 to 5 inches above the plane of the surface of the center section.

27. The electrode of claim 26 wherein the means for elevating the outside sections includes one or more inflatable bags mounted under each section.

28. The electrode of claim 27 wherein all adjacent edges of the sections forming the top surface are in electrical contact with one another when the outside sections are in their fully lowered positions.

29. The electrode of claim 28 wherein the electrical contact between each pair of adjacent edges comprises an elongated member, made of conducting material, that is aligned with the edges, underlays both edges, and contacts both of the sections when the outside section is in the fully lowered position.

30. The electrode of claim 29 wherein the box is made of aluminum.

* * * * *